US005279002A

United States Patent [19]

Ellis et al.

[11] Patent Number: 5,279,002

[45] Date of Patent: Jan. 18, 1994

[54] INLAID TILE GUTTER SYSTEM

[75] Inventors: Herbert S. Ellis, Menands; Thomas Delp, Schenectady, both of N.Y.

[73] Assignee: Aquatic Amusement Associates, Ltd., Cohoes, N.Y.

[21] Appl. No.: 879,164

[22] Filed: Apr. 30, 1992

Related U.S. Application Data

[63] Continuation of Ser. No. 573,879, Aug. 27, 1990, abandoned.

[51] Int. Cl.[5] ..... E04H 4/12; E04H 4/14

[52] U.S. Cl. ..... 4/510; 4/506; 52/344; 52/385

[58] Field of Search ..... 4/488, 496, 506-512; 52/102, 169.7, 344, 385, 388

[56] References Cited

U.S. PATENT DOCUMENTS

| | | | |
|---|---|---|---|
| 1,965,282 | 7/1934 | Ellithorpe et al. | 52/385 |
| 2,208,191 | 7/1940 | Kerr | 52/344 |
| 2,272,162 | 2/1942 | Lackey | 52/344 |
| 2,983,080 | 5/1961 | Whiteside | 52/385 |
| 3,938,199 | 2/1976 | Laven | 4/510 |
| 3,972,077 | 8/1976 | Whitten, Jr. | 4/496 |
| 4,007,566 | 2/1977 | Molitor | 4/510 X |
| 4,059,856 | 11/1977 | Patterson | 4/510 X |
| 4,400,834 | 8/1983 | Corna et al. | 4/506 |
| 4,494,257 | 1/1985 | Peirish | 4/510 X |
| 4,642,960 | 2/1987 | Wallover, III | 52/385 X |
| 4,985,007 | 1/1991 | Ellis | 4/496 X |

FOREIGN PATENT DOCUMENTS

| | | | |
|---|---|---|---|
| 1174063 | 12/1969 | United Kingdom | 4/510 |

*Primary Examiner*—Henry J. Recla
*Assistant Examiner*—Robert M. Fetsuga
*Attorney, Agent, or Firm*—Heslin & Rothenberg

[57] ABSTRACT

An inlaid tile gutter system for use in swimming pools contains a channel, braces mounted atop the primary gravity flow channel and stiffeners mounted on the poolside of the channel provide a relatively stiff gutter system capable of withstanding deformations due to excessive loadings and impact. Ferro concrete material may be placed within channels formed by the vertical stiffeners to provide a support and a base upon which to set tile.

11 Claims, 3 Drawing Sheets

INLAID TILE GUTTER SYSTEM

This application is a continuation of application Ser. No. 07/573,879, filed Aug. 27, 1990, now abandoned.

BACKGROUND OF THE INVENTION

This invention relates to the field of swimming pools and, more particularly, to an inlaid tile gutter system.

In the swimming pool industry, it is often desirable to have a stainless steel perimeter gutter system which is capable of handling large amounts of water for filtration. One disadvantage with the stainless steel gutter systems is that they have a very slippery stainless steel poolside surface. Consequently, it is difficult for swimmers to firmly support themselves along the inside pool wall.

In pools used for competitive swimming, swimmers use the upper portion of the inside of the pool to turn when they reach the end of the pool during a race. Typically, the swimmer inverts his body 180° prior to touching the side of the pool and then pushes off the side with his or her feet. Therefore, a non-slippery surface is preferable so that the competitive swimmers may get the optimum push off of the pool wall to more efficiently transfer his or her momentum in the opposite direction. Also, competitive swimming rules require backstroke swimmers to utilize the interior surfaces of the pool's gutter for the starts of their races. The backstroker must be in contact with the sidewall of the pool prior to the start of the race and push off the upper inner side of the pool (i.e., the gutter) to begin the race. The more slippery the gutter wall is, the more difficult it is for the backstroker to get a quick start thereby putting him or herself at a competitive disadvantage from the rest of the field.

Apart from competitive swimming, it is otherwise desirable to have a non-slippery inside upper portion of the swimming pool. For example, lifeguarding classes, swimming classes, children's swimming sessions, wading, etc. would be made easier with a non stainless steel perimeter. As a result, it is desirable to create a gutter system which is capable of supporting a non-slippery surface within the water.

Because of its slipperiness and propensity for deformation, it is preferable to have a material other than stainless steel on the outer poolside surface of the gutter while having stainless steel for the inner gutter lining. Tile is preferably used on upper walls in swimming pools not having perimeter stainless steel gutter systems because of its hardness, non slippery surface and resistance to water. Typically, it has not been possible to utilize tile on the outer walls of the stainless steel gutter systems. Stainless steel is not a surface upon which tile may be successfully applied because tile cements, glues, grouts and mortars do not bond well to stainless steel. Any attempt to glue or cement tile directly to the stainless steel gutter typically results in the tile falling off the gutter wall.

Another problem with conventional stainless steel gutter systems is that the thickness of the stainless steel wall of the gutter is propensive to flexation and deformation. If the wall is subjected to a sufficient force it will bend, deflect or even deform. This problem is compounded with the advent of rolling bulkheads which use the gutters of swimming pools as bearings to support the bulkhead weight. These bulkheads are long spans which cover the width of a pool to effectively divide a swimming pool into two separate pools. The bulkheads are capable of rolling along the gutter system at different pool lengths to change the effective pool size. Because the weight of these bulkheads is supported by the gutter systems, the walls of the stainless steel gutters will deform due to stress placed on the gutters. Bonding tile to the stainless steel is, therefore, further compounded by the problem of the gutter walls bending and deforming due to impacts and bulkhead loadings.

It is therefore an object of the present invention to provide a stainless steel gutter system which is capable of supporting rolling bulkheads without excessive deformation of the gutter walls.

It is also an object of the invention to provide a gutter system which contains an outer surface which forms the upper inner wall surrounding the entire perimeter of a swimming pool.

It is another object of the present invention to provide a stainless steel gutter system, preferred because of the smoothness of the inner lining and propensity to allow water to flow therethrough without the accumulation of debris and other foreign substances therein, which contains an outer tile surface forming the upper inner wall of the swimming pool.

It is also another object of the present invention to provide a technique for an inlaid tile gutter system.

SUMMARY OF THE INVENTION

To achieve these and other objects of the invention, an inlaid tile gutter system in accordance with the present invention comprises a channel for receiving pool overflow, the channel defined by a back wall and a front wall protruding upwards from a lower surface; a plurality of braces mounted to the front wall and the channel; a plurality of stiffeners mounted on the outer side of the front wall of the channel; and a lower lip protruding from the outer side of the front wall for supporting a ferro concrete material thereon.

The front wall of the channel may contain an outwardly protruding upper lip so that the upper lip, lower lip and front wall form a cavity for retaining ferro concrete filling material. The ferro concrete material may be placed within the cavity. The stiffeners may be effectively L-shaped and vertically mounted on the front wall of the channel so that each side of the stiffener and the front wall forms a vertically extending channel. The cavity formed by the front wall upper lip and lower lip is divided into a plurality of vertically extending channels. The ferro concrete material used within the system may comprise a reinforcing means placed over a non-shrink grout. The reinforcing means may be a wire mesh. The vertical stiffeners may contain a plurality of holes therein.

The invention may be used in a variety of different types of pool gutter designs. For example, the inlaid tile gutter system may be implemented in conventional U-shaped gutter designs as well as advanced surge recovery systems.

The invention also provides a method for constructing an inlaid tile gutter system including installing a gutter system about the perimeter of the pool, mounting a plurality of braces within the gutter to support the front wall of the gutter system, mounting a plurality of stiffeners vertically on the outside of the front wall of the gutter system, laying a non-shrink grout on the front wall of the gutter and between the stiffeners, placing a reinforcing means within the grout, and setting tile in the grout.

DESCRIPTION OF THE PREFERRED EMBODIMENT

Figure 1:
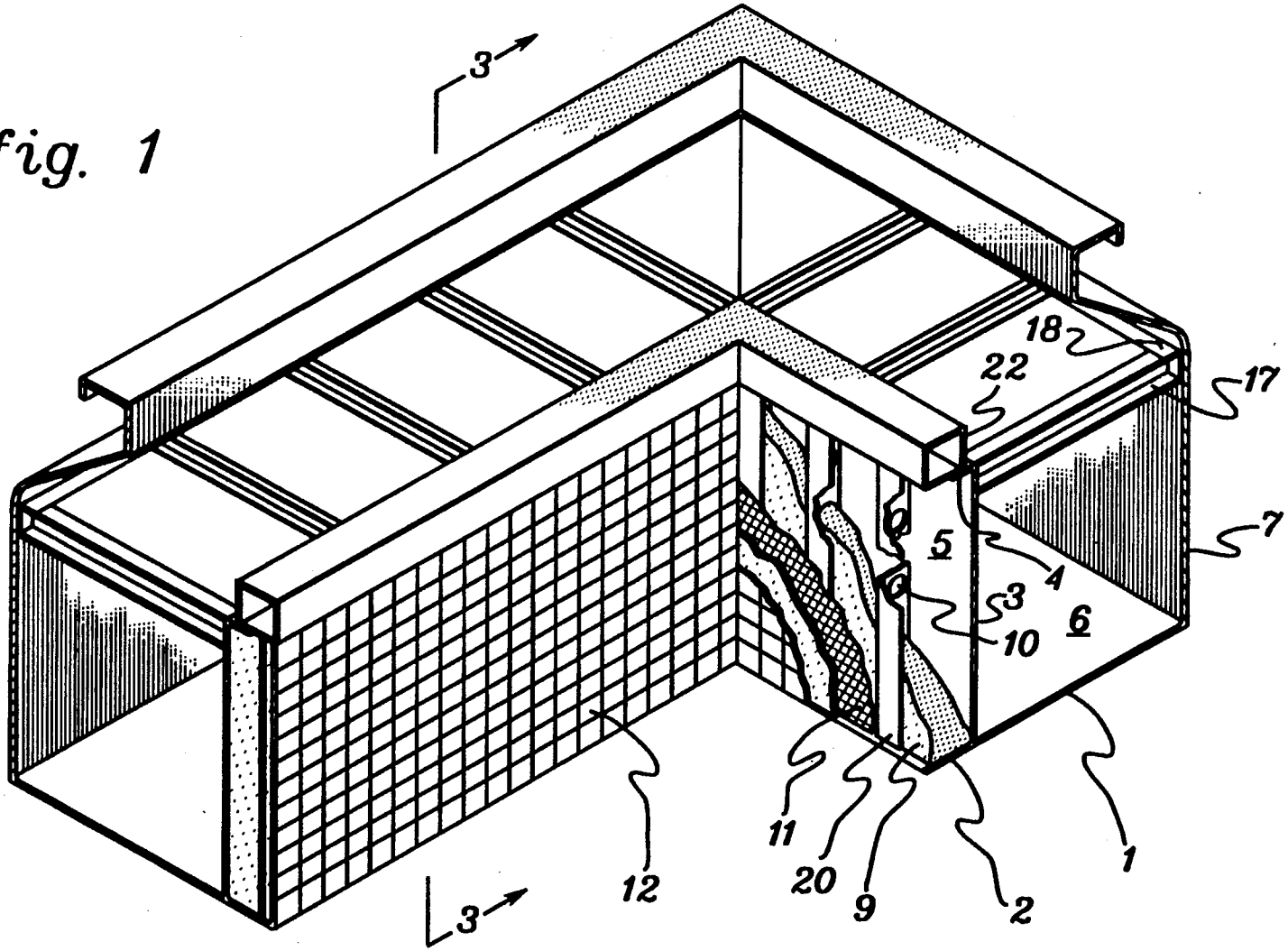
FIG. 1 is an isometric view of a portion of the inlaid tile gutter system as incorporated into a conventional perimeter gutter.

Referring to the drawings, the inlaid tile gutter system according to the present invention can be utilized in a variety of different gutter configurations. The inlaid tile gutter system is mountable around the outer perimeter of a pool to form the pool boundary. The poolside wall of the gutter system is resistant to bending and deformation while capable of withstanding forces from loadings and impacts.

The inlaid tile gutter system preferably contains one or more stainless steel sheets fabricated to form a channel 6 defined by the perimeter of the gutter cross section. The gutter system may form a rectangular U-shaped channel. However, different gutter configuration and shapes may be incorporated within the present invention. Although the channel may be made of one piece stainless steel, it is possible to construct the channel from multiple pieces of stainless steel. The stainless steel is generally pre-fabricated twelve gauge stainless steel for ease of assembly in the field. However, other stainless steel thicknesses may suffice.

A lower lip 2 is formed from a lower surface 1 on the pool side of the gutter system and extends from a front wall 3 of the gutter. The lower lip 2, the front wall 3 and an upper lip 4 are all part of the cross section of the gutter system which extends throughout the perimeter of the pool. The lower lip 2, front wall 3 and upper lip 4 are integrally formed to define a cavity 5 (see FIGS. 1 and 4) running along the length of the front wall 3.

Figure 4:
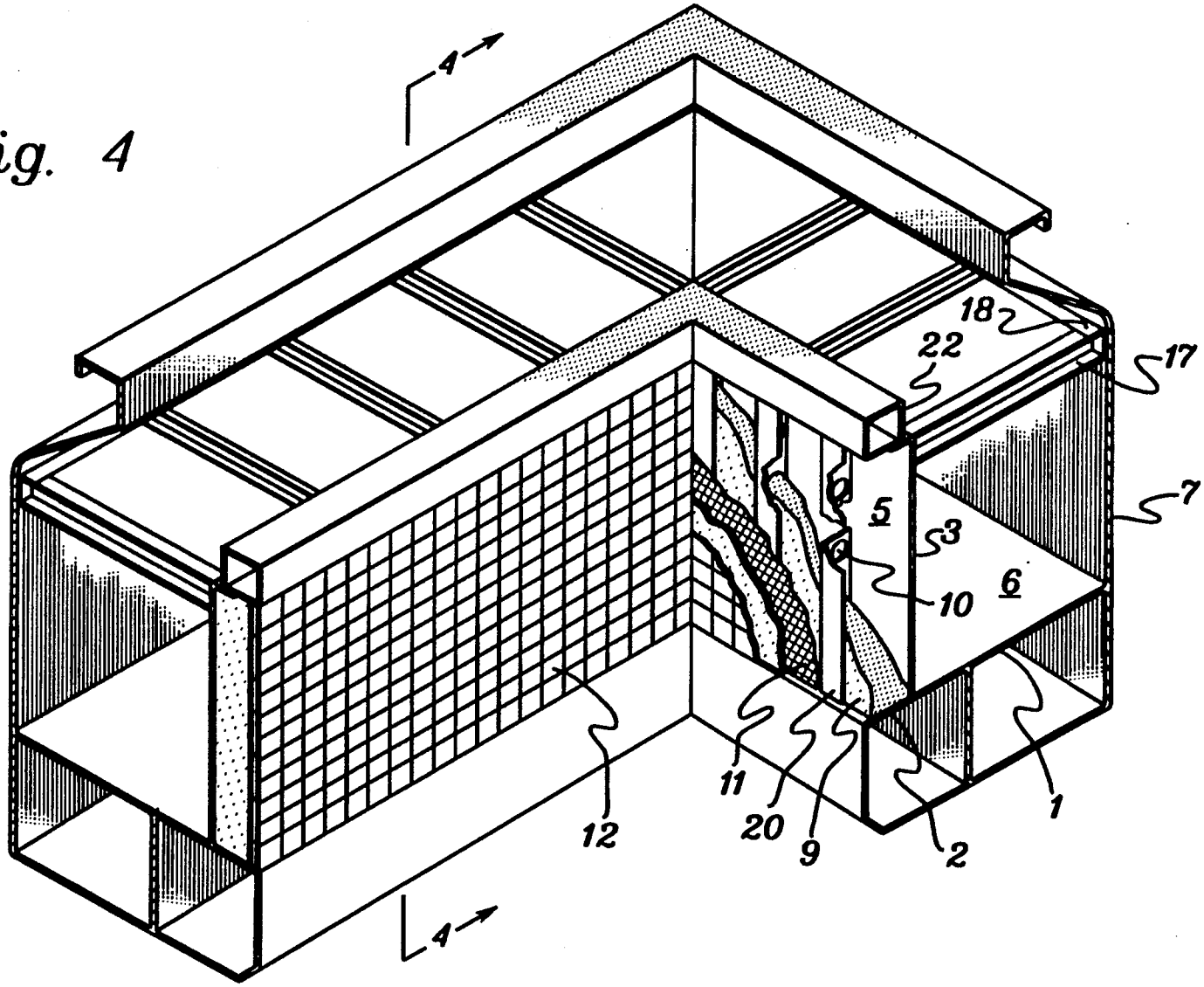
FIG. 4 is an isometric view of the embodiment of the inlaid tile gutter system as shown in FIG. 2 taken along line 4—4.

To give the gutter system the structural integrity necessary to support inlaid tile, braces 17 are mounted horizontally between deck side wall 7 and front wall 3 (towards the upper lip 4). The braces absorb impacts to the front wall 3 of the gutter system. Preferably, the braces 17 are configured and mounted in such a way that horizontally oriented U-shaped channels are formed as shown in FIGS. 1 and 4. A continuous length L-bracket 18 may be used to mount the braces. The L-bracket may be welded to deck side wall 7 and the braces welded on the top lip 4, the L-bracket and on the front wall 3. Alternatively, a second L-bracket (not shown) may be mounted on front wall 3 and the braces welded thereto. The braces may also be directly welded at each end to deck side wall 7 and front wall 3.

Figure 2:
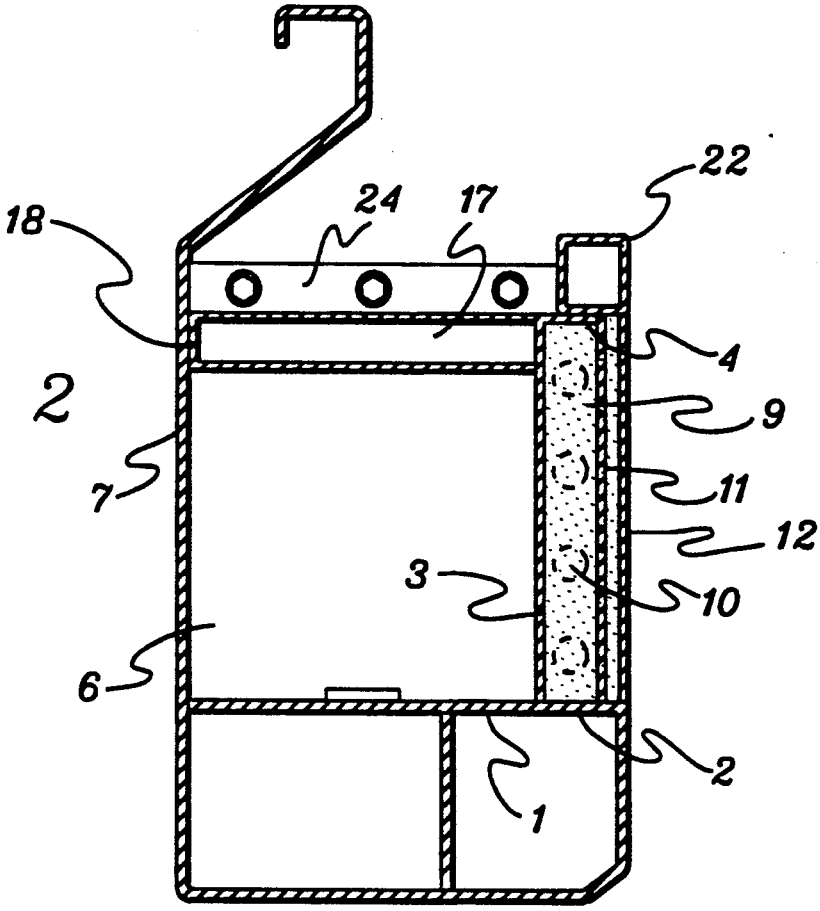
FIG. 2 is a cross-sectional view of a second embodiment of the inlaid tile gutter system as it pertains to a surge recovery gutter system.
Figure 3:
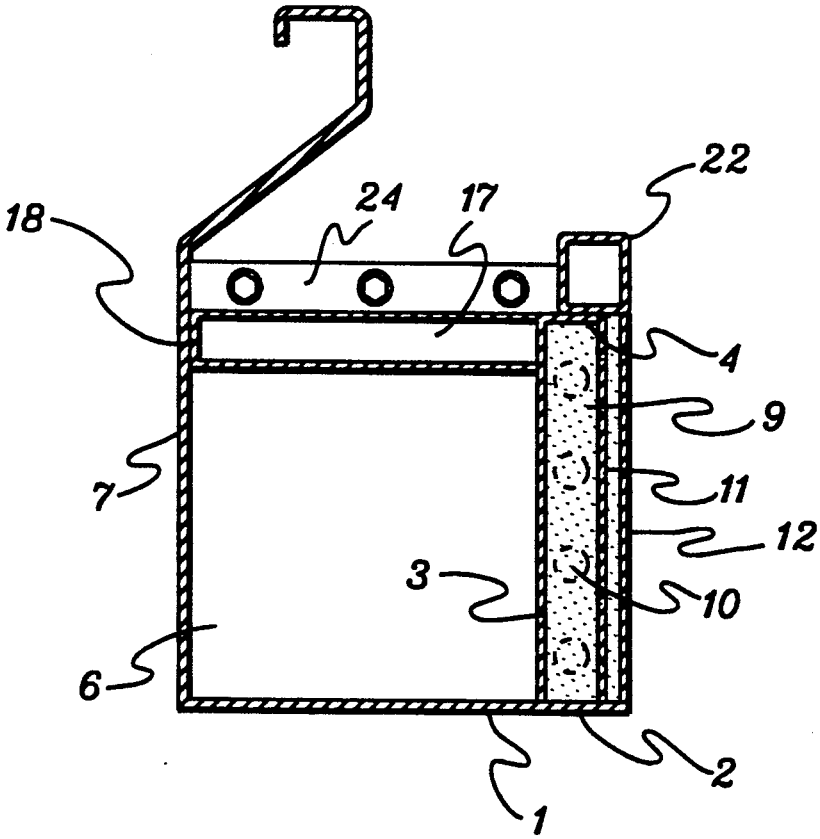
FIG. 3 is a cross-sectional view of the embodiment of the inlaid tile gutter system as shown in FIG. 1 taken on line 3—3.

Stiffeners 20 are mounted vertically between the upper lip 4 and lower lip 2 of the cavity 5. The stiffeners support loadings on the gutter (such as those attributable to rolling bulkheads) serve as a structural reinforcement to a ferro concrete inlay, and help prevent bending of the front wall 3. The stiffeners may be effectively L-shaped thereby forming a vertically extending channel with the front wall 3 when mounted as shown in FIGS. 1 and 4. Other shaped channels may also provide sufficient structural integrity to the system. However, the channel should have an effective shape which provides stiffness to a ferro concrete inlay 9, such as shown in FIGS. 2 and 3, placed within the cavity 5. The stiffeners 20 may be made of twelve gauge stainless steel and contain a plurality of holes 10 to provide a more structurally sound and uniform surface. Preferably four holes an inch and a half in diameter are used. It is apparent, however, that other stiffener thickness, as well as numbers and dimensions of holes may also be used.

A PVC safety grate 24 is preferably mounted on top of the channel stiffeners to provide a safe surface which will not cut skin. The grate 24 also prevents objects from falling within the flow channel 6.

The vertical stiffeners 20 are preferably mounted at no greater than 2 foot intervals along the length of front wall 3 such that a plurality of vertically extending channels are formed by the plurality of vertical stiffeners. This configuration provides a structurally stable front wall 3 and pool side surface which is capable of accepting the ferro concrete mixture 9.

The ferro concrete mixture may comprise a typical non shrink reinforced grout 9 and may be placed within the channels along the front wall and above the lower lip. The reinforced grout 9 may contain typically commercially available bonding agents. Usually, up to 2½ inches of reinforced grout 9 may be used to form a relatively thick slab. The holes 10 within the stiffeners allow the grout to pass therethrough further providing a more structurally stable pool side face. The grout 9 should be placed within the cavity 5 and vertically formed channels to form a base upon which a reinforcing wire mesh 11 can be placed. The wire mesh 11 provides a surface which is capable of holding tile thereon. The wire mesh 11 is placed on the outer layer of the pool side face such that a thin layer of tile grout 9 may be feathered thereon. Tiles 12 are then set on the grout 9 to provide the pool side face which will be exposed to water. The tile surface 12 can be grouted and sealed to be water tight.

The braces 17 are preferably spaced throughout the length of the gutter system to provide for optimum structural stability of the front wall 3 and pool side face. The spacing of the braces 17 depends upon the gutter configuration and depth as well as the stainless steel thickness. Preferably, however, there should exist one brace 17 for each vertical column 20. However, a different proportion of braces 17 to columns 20 may be used.

A handhold 22, forming the pool lip, is typically welded on upper lip 4 to provide a safe surface for swimmers to grip their hands. The handhold is typically welded to upper lip 4. A non slip adhesive surface may be placed on the upper portion of the handhold 22 for better gripping.

Different types and sizes of gutter systems are usable for various different pools. For example, the inlaid tile gutter system may be used in pools which contain only a single U-shaped channel or in competitive racing pools which require surge recovery systems as shown in FIGS. 2 and 4.

The entire gutter system is mounted around the perimeter of a pool. Preferably, galvanized anchor bolts are constructed within a channel around the perimeter of the cement which forms the configuration of the pool. A galvanized steel stiffener which fastens to the anchor bolt surrounds and readily secures the gutter system.

In accordance with the present invention, the inlaid tile gutter system may be constructed in the field during installation of the entire gutter system or prefabricated prior to installation. For example, the ferro concrete material 8 may be placed within the cavity 5 during manufacture of the gutter system prior to installation. In this manner, field work could be minimized so that only the tile 12 need be inlaid onto the ferro concrete material during installation. Alternatively, the stainless steel and ferro cement inlay can be installed within the field.

The aforementioned description of the inlaid tile gutter system corresponds to each of the embodiments shown in FIGS. 1-4. Although the inlaid tile gutter system has been disclosed in the embodiments depicted therein, the invention is not limited to these embodiments. Any such variations to the inventive features are intended to be included within the scope of the invention as defined by the following claims.

I claim:

1. A gutter system for use in a swimming pool, said gutter system being fabricated of a slippery, deformable sheet metal material, yet suitable for the secure installation of tile thereon, comprising:

a channel for receiving pool overflow, said channel defined by a back wall and a front wall protruding upwards from a lower surface;

a lower lip protruding from the outerside of the front wall;

a plurality of braces mounted between the front wall and the back wall of the channel; and a plurality of stiffeners mounted on the outerside of the front wall of the channel above the lower lip wherein a ferro-concrete structural filling material is set upon the lower lip, outer wall and stiffeners to enable tile to be laid thereon.

2. The gutter system for use in a swimming pool of claim 1 wherein the front wall of the channel contains an outwardly protruding upper lip, said upper lip, lower lip and front wall forming a cavity capable of retaining ferro-concrete filling material.

3. The gutter system for use in a swimming pool of claim 2 wherein a ferro-concrete material for setting of tile is placed within the cavity.

4. The gutter system for use in a swimming pool of claim 3 wherein the ferro-concrete material comprises a reinforcing means placed over a non shrink grout.

5. The gutter system for use in a swimming pool of claim 4 wherein the reinforcing means is a wire mesh.

6. The gutter system for use in a swimming pool of claim 3 wherein the braces are U-shaped.

7. The gutter for use in a swimming pool of claim 3 wherein the stiffeners are vertically mounted on the front wall of the channel enabling the stiffeners to form vertically extending channels receiving said ferro-concrete material, wherein the stiffener form a segmented cavity.

8. The gutter system for use in a swimming pool of claim 7 wherein the vertical stiffeners contain a plurality of holes therein.

9. The gutter system for use in a swimming pool of claim 1 further comprising means for supporting the braces, wherein said means comprises a first continuous support angle mounted at the upper portion of the back wall of the channel such that the braces may be mounted thereon.

10. A gutter system capable of supporting inlaid tile thereon for use in a swimming pool comprising:

a channel for receiving pool overflow, said channel having a back wall, a bottom surface, and a front wall having an outwardly facing upper support lip and an outwardly facing lower support lip;

a plurality of braces horizontally oriented between the upper portions of the front and back walls of the gutter;

means for supporting the horizontally oriented braces to the upper portions of the front and back walls of the gutter;

a plurality of vertical stiffeners vertically mounted on the outerside of the front wall of the channel between the upper and lower support lips to form vertically extended channels capable of receiving a non shrink grout;

non shrink grout set within said vertically extending channels;

wire mesh placed within the grout; and tile inlaid on the grout forming the upper inner wall of a pool.

11. A method of installing a gutter system having inlaid tile thereon for a swimming pool comprising:

installing a gutter system having a front wall, rear wall and bottom about the perimeter of the pool;

mounting a plurality of braces between the front and rear walls of the gutter system;

mounting a plurality of stiffeners vertically on the outside of the front wall of the gutter system;

laying a non-shrink grout on the outside of the front wall of the gutter and between the stiffeners;

placing a reinforcing means within the grout; and setting tile in the grout.

* * * * *